United States Patent [19]

Stegens

[11] 4,297,661

[45] Oct. 27, 1981

[54] FERRITE SUBSTRATE MICROWAVE FILTER

[75] Inventor: Ronald E. Stegens, Brookeville, Md.

[73] Assignee: Communications Satellite Corporation, Washington, D.C.

[21] Appl. No.: 108,248

[22] Filed: Dec. 27, 1979

[51] Int. Cl.[3] ..... H01P 1/203; H01P 1/215; H01P 3/08

[52] U.S. Cl. ..... 333/204; 333/246

[58] Field of Search ..... 333/202-206, 333/211, 238, 245, 246, 209-210, 248, 263, 223-226, 161, 24.1, 24.2

[56] References Cited

U.S. PATENT DOCUMENTS

| | | | |
|---|---|---|---|
| 3,448,409 | 6/1969 | Moose et al. | 333/238 X |
| 4,020,429 | 4/1977 | Bickley | 333/205 |
| 4,188,594 | 2/1980 | Bongianni | 333/211 X |

*Primary Examiner*—Marvin L. Nussbaum

*Attorney, Agent, or Firm*—Sughrue, Mion, Zinn, Macpeak and Seas

[57] ABSTRACT

A non-magnetized ferrite material is provided as the propagating medium for a microwave transmission line such as a microstrip or stripline transmission line. The transmission system is adapted to provide a "high pass" filter characteristic by selecting the saturation magnetization of the ferrite as a function of the desired cut-off frequency such that frequencies below the cut-off are absorbed by the ferrite material thereby producing a low reflection coefficient, while frequencies above the cut-off are transmitted with very little attenuation. One of the conductors of the transmission system can further have microwave circuit elements located thereon which provide a second "filter" characteristic, such as a reactive filter or a tunnel diode. The filter characteristics produced by the ferrite material and the circuit elements combine to produce a desired system filter characteristic.

8 Claims, 13 Drawing Figures

MICROSTRIP ON FERRITE SUBSTRATE

STRIPLINE

MICROSTRIP

FIG 4 MICROSTRIP ON FERRITE SUBSTRATE
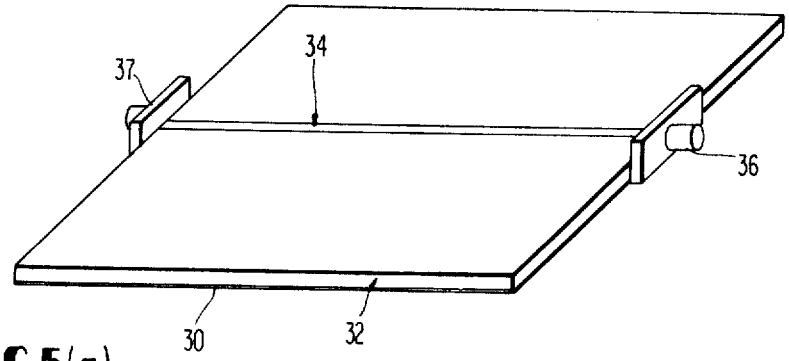
FIG 5(a)
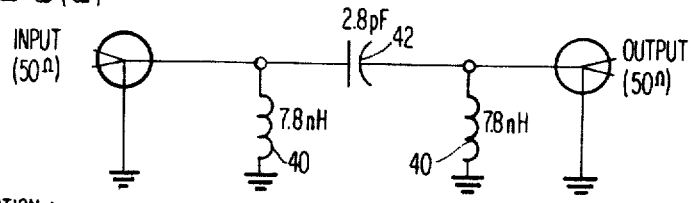
FIG 5(b)
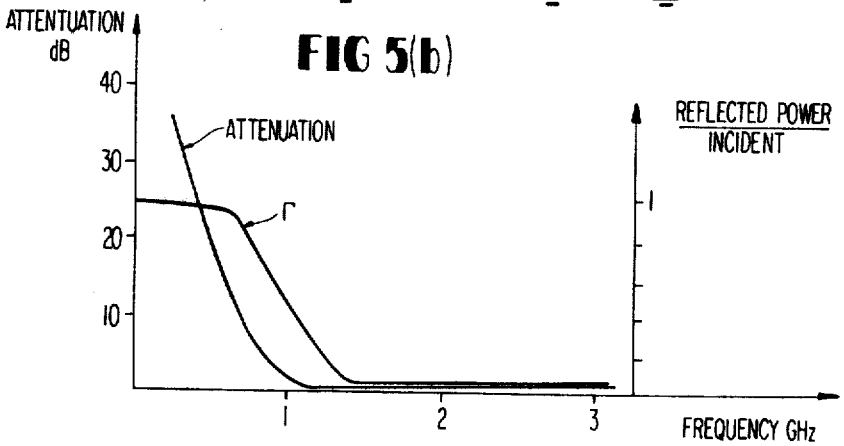
FIG 5(c)
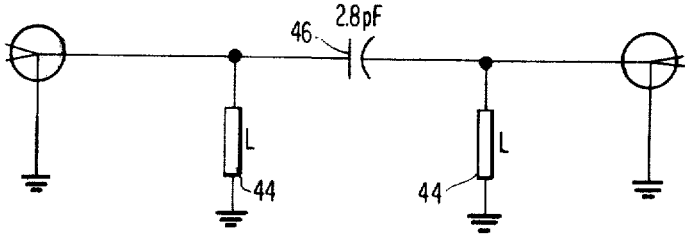
FIG 5 PRIOR ART HIGH PASS FILTERS

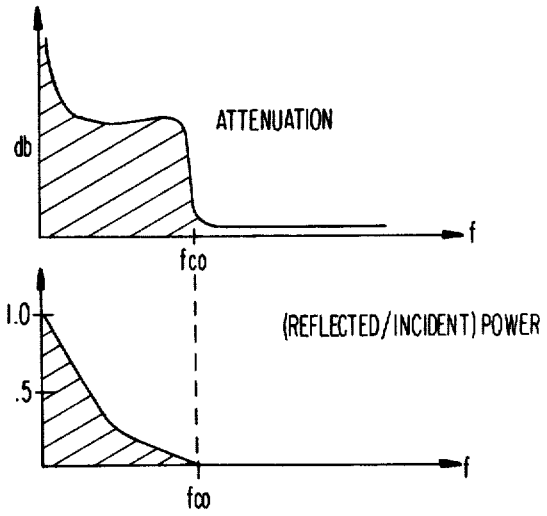
FIG 6 CHARACTERISTICS OF COMBINED FILTER STRUCTURE
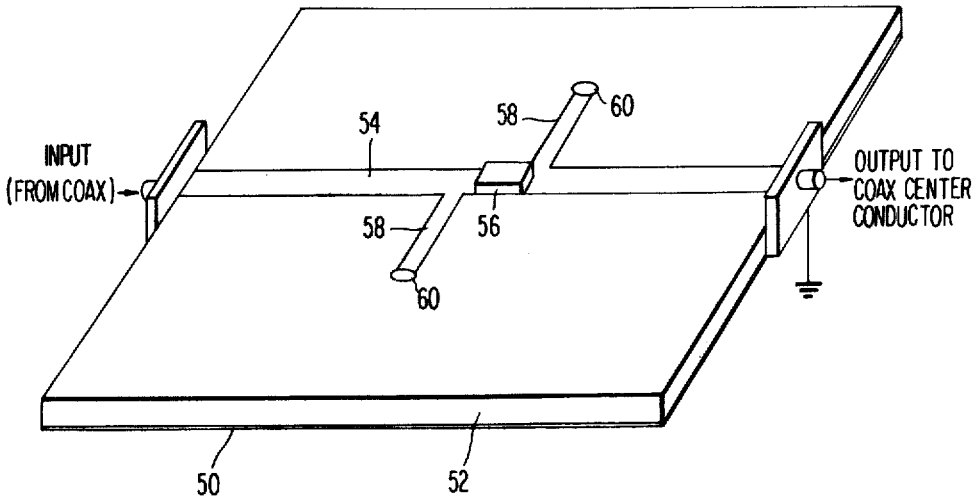
FIG 7 FERRITE / REACTIVE FILTER

FERRITE SUBSTRATE MICROWAVE FILTER

BACKGROUND OF THE INVENTION

There are various well-known techniques of fabricating microwave circuits which utilize magnetic (magnetized) ferrite substrates. Integrated microwave circuits such as phase shifters, isolators, circulators and resonance/field-displacement devices (filters), for example, as respectively taught in U.S. Pat. Nos. 3,588,759 to Buck, 3,560,892 to Chiron, 3,448,409 to Moose, and 4,020,429 to Bickley, may be designed by depositing stripline patterns on a substrate of ferrite material and applying a magnetic field. Characteristics such as frequency response or phase shifting are varied by the external magnetic field which affects the permeability of the substrate material.

All of the prior art techniques employing ferrite substrates have heretofor applied a steady magnetic field to the substrate. The application of a steady (but possibly variable) magnetic field to ferrite substrate causes an alignment of the magnetic moments of the electrons in the ferrite material, and the ferrite exhibits anisotropic behavior. All known prior art ferrite devices have heretofore relied on this anisotropic behavior of magnetized ferrite substrates.

SUMMARY OF THE INVENTION

It is an object of the present invention to provide a non-magnetized ferrite substrate having a saturation magnetization chosen relative to an operating frequency to provide a high pass filter function independent of strip line circuitry.

It is a further object of the invention to provide a non-magnetized ferrite substrate having a magnetization saturation chosen relative to an operating frequency, the non-magnetized ferrite substrate having a microwave circuit deposited thereon, the microwave circuit having a second filter function which cooperates with the filter function provided by the non-magnetized ferrite substrate to produce a combined filter function.

It is a further object of the invention to provide a microwave high pass filter circuit having a first frequency cut-off deposited on a non-magnetized ferrite substrate having a magnetization saturation chosen to effect a second high pass filter function relative to the first high pass filter function, the high pass filter functions of the microwave circuit and of the ferrite substrate combining to produce a third high pass filter characteristic.

It is a further object of the invention to provide a high pass filter characteristic employing a non-magnetized ferrite substrate having a magnetization saturation chosen to produce the desired frequency cut-off having extremely abrupt attenuation below the critical frequency, negligible insertion loss above the critical frequency, and a small reflective to incident power ratio both above and below the critical frequency.

BRIEF DESCRIPTION OF THE DRAWINGS

FIG. 4 illustrates a first embodiment of the present invention comprising a non-magnetized ferrite substrate having a conductive strip deposited thereon.

FIGS. 5A and 5C illustrate reactive filters.

FIG. 5B is a plot of the attenuation and reflection characteristics of the reactive filters of FIGS. 5A and 5C.

FIG. 6 is a plot of the desired attenuation and reflection characteristics of a reactive filter deposited on the non-magnetized ferrite substrate in accordance with an embodiment of the present invention.

FIG. 7 is an illustration of the reactive filter deposited on the non-magnetized ferrite substrate.

DESCRIPTION OF THE PREFERRED EMBODIMENTS

Figure 1A:
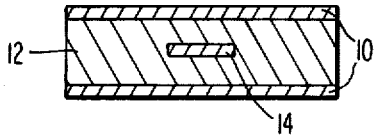
PRIOR ART FIG 1(a)
FIGS. 1A and 1B illustrate an end and top view, respectively, of a prior art stripline transmission system.
Figure 1B:
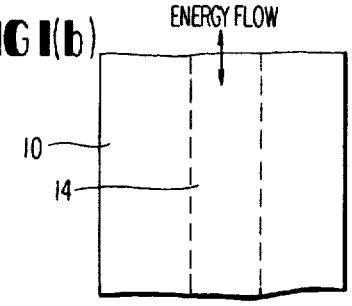
Figure 2A:
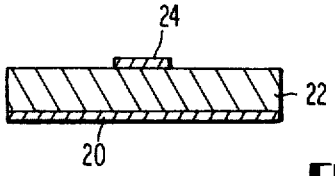
PRIOR ART FIG 2(a)
FIGS. 2A and 2B illustrate an end and top view, respectively, of a prior art microstrip transmission system.
Figure 2B:
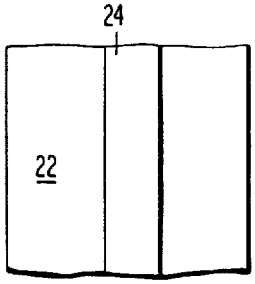

Two electromagnetic transmission systems are generally shown in FIGS. 1 and 2. FIG. 1 is commonly referred to as a "stripline" while FIG. 2 illustrates the well known "microstrip" structure. The stripline structure of FIG. 1 is comprised of a pair of conductors 10 which constitute the transmission system ground plane, a dielectric material 12 and center conductor 14. The microstrip structure as shown in FIGS. 2A and 2B is comprised of the ground plane 20, dielectric substrate 22 and conductor 24.

In accordance with the present invention, the dielectric substrate 12 in the case of stripline, and 22 in the case of microstrip, is comprised of a ferrite material characterized by a saturation magnetization ($4\pi M_s$) and dielectric constant ($\epsilon_r$). Unlike the prior art, the ferrite material in accordance with the present invention is unmagnetized and is at no time in the presence of an external magnetic field. The effective permeability of an unmagnetized ferrite medium is given by Denlinger as $$\mu_{eff} = \tfrac{1}{2} + \tfrac{1}{2}\sqrt{1 - m_s^2} \tag{1}$$

Where $$m_s \approx 2.8(4\pi M_s)/f \tag{2}$$

with f being the frequency in MHz and $4\pi M_S$ is given in Gauss. See Delinger, E. J., *A Dynamic TE-TM Mode Solution for Microstrip,* Lincoln Laboratories, M.I.T., Lexington, Mass., MS-2577.

A computer solution can be obtained for $\mu_{eff}$ versus frequency from which the propagation constant $\gamma$ can be calculated as:

$$\gamma = jk \tag{3}$$

where $$k = \frac{2\pi}{\lambda_o}\sqrt{\epsilon_r \mu_{eff}} \tag{4}$$

($\lambda_o$=free space wavelength=c/f)

For real values of k, normal propagation of energy will occur, while for imaginary or complex values of k, absorption will occur. Examination of equations (1)-(4)

indicates that absorption of energy will occur below a frequency given by $$f_{CRIT} \approx 2.8 * 4\pi M_s \quad (5)$$

Since the saturation magnetization $4\pi M_S$ may be chosen at will by the proper selection of ferrite material, the high pass transmission systems of FIGS. 1 and 2 may be made to have any desired cut-off frequency, namely $f_{CRIT}$. While the present invention is shown as having general application with regard to the stripline and microstrip transmission systems of FIGS. 1 and 2, it should be noted that the above results are equally valid for other transmission systems such as coaxial or wave guide systems when used in conjunction with the appropriate ferrite material.

Figure 3:
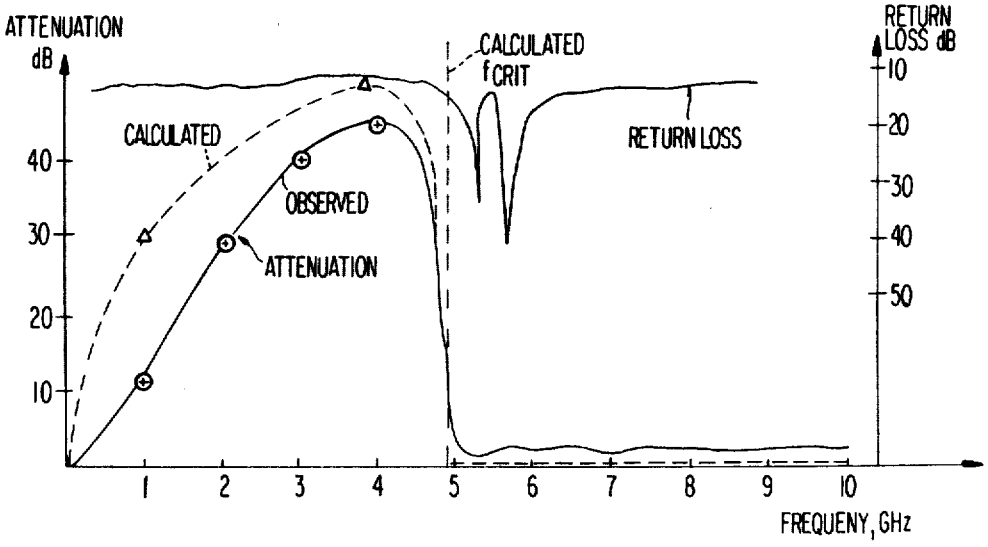
FIG. 3 is a plot of the frequency response and reflected-to-incident power ratio for the non-magnetized ferrite substrate in accordance with the present invention with the configuration shown in FIG. 4.

FIGS. 3 and 4 illustrate one working example of the micro strip transmission system. The transmission system of FIG. 4 illustrates the microstrip structure comprising a metalized bottom conductor 30, unmagnetized ferrite substrate 32, conductive strip 34 and coaxial connectors 36 and 37. The ferrite material 32 is designated as "TRANS-TECH Type TT1-105" and has a saturation magnetization ($4\pi M_s$) of 1,750 Gauss and a dielectric constant of 12.0. The calculated value of $f_{CRIT}$ from equation (5) is 4.9 GHz. Since the ferrite substrate can be expected to behave approximately like a dielectric at frequencies above 4.9 GHz, the conductor width was selected to produce a characteristic impedance of 50 ohms through techniques well known in the art. Conductive strip 34 has a width of 0.038" (inches), a length of 2" and a thickness of 0.001". The thickness of substrate 32 is 0.050".

The frequency characteristic of the micro strip transmission system of FIG. 4 is illustrated in FIG. 3. The expected results were calculated using equations 1–4. The variation between the calculated and observed results were expected inasmuch as no exact solution exists for a microstrip on a medium with $\mu_{eff}<0$. Of particular significance is the observation that the input reflection coefficient remains small in both the stop band (below 4.9 GHz) and in the pass band. Thus, such structures exhibit an "all matched" high pass characteristic.

It is thus seen that a low pass filter function can be achieved by the proper selection of the magnetization saturation which is a function of the particular non-magnetized ferrite material employed as a substrate. The characteristics of such a filter not only include an extremely sharp attentuation of signals directly below the critical frequency, but also an excellent reflected-to-incident power ratio both above and below the critical frequency.

With regard to a further aspect of the present invention, the filter characteristics of the ferrite substrate filter can be combined with conventional microwave components by depositing the conventional microwave structure on the ferrite substrate. For example, in some applications the high pass characteristic of the filter illustrated in FIG. 4 does not adequately attenuate at very low frequencies. This is in contrast to the well-known lumped or distributed element high pass filters which are constructed of reactive elements as shown in FIGS. 5A or 5C, respectively. The design techniques for such filters are well known in the art. FIG. 5B illustrates the frequency characteristic of the filter attenuation and reflection coefficients. The disadvantages of this type of filter are that substantial portions of the transmitted energy are reflected to the source when the frequency of the transmitted energy is below the cut-off frequency, and that abrupt cut-off characteristics can only be obtained by using a large number of circuit elements. This leads to large structures with each element requiring high accuracy. On the other hand, this type of filter exhibits a very high attenuation approaching infinity at very low frequencies as opposed to the ferrite substrate filter which ceases to attenuate sufficiently at these low frequencies for certain applications.

The filters shown in FIGS. 5A and 5C comprise capacitors 42, 46 and inductors 40 and 44, respectively. In the example illustrated in FIGS. 5A and 5C, the filters have a cut-off frequency of 1 GHz; capacitors 42 and 46 are each 2.8 pF, inductors 40 are each 7.8 NH or "nanohenrics" and inductors 44 are each 75 ohm transmission line, 0.094 wavelengths long at 1 GHz. In order to avoid confusion, the cut-off frequency for the reactive filters comprised of lumped or distributive elements will be indicated as $f_R$.

In accordance with this aspect of the present invention, the advantages of the lumped or distributed filters and the advantages of the ferrite filter are combined. Simplicity of construction is preserved by permitting much or all of the circuit to be produced directly on the ferrite substrate by well-known photo etching techniques. The distributed element filter of FIG. 5C is etched upon a ferrite substrate. Both the distributed element cut-off frequency $f_R$ and the substrate critical frequency $f_{CRIT}$ are chosen to produce a filter having (1) an extremely abrupt increase in attenuation below the cut-off frequency of the combined device (denoted $f_{CO}$), (2) very high attenuation at very low frequencies, (3) a broad frequency range below $f_{CO}$ where only small reflections will occur at the input port, and (4) a relatively high constant attenuation below $f_{CO}$. The desired attenuation in reflection characteristics of the combined filter are illustrated in FIG. 6.

For any desired cut-off frequency $f_{CO}$ for the combined ferrite/reactive filter, $f_{CRIT}$ is chosen to be approximately equal to, slightly above, or slightly less than $f_{CO}$. Inasmuch as the attenuation due to the ferrite filter and the attenuation due to the reactive filter are substantially additive, $f_R$ of the reactive filter can be chosen to be slightly less than $f_{CRIT}$ to augment the ferrite filter characteristics. It should be apparent, however, that $f_R$ can be chosen to have any particular relationship to $f_{CRIT}$, i.e. greater than or equal to, depending on the desired system characteristics.

An example of the combined ferrite/reactive filter produced in accordance with this aspect of the present invention is illustrated in FIG. 7. The filter produced in the example shown in FIG. 7 has a desired cut-off frequency $f_{CO}$ of 2 GHz. The ferrite material is of the type "G-610" and is chosen for a critical frequency of 1.9 GHz. The ferrite substrate 52 measures 0.050"×2.0"×2.0" and is mounted on metal ground plane 50.

The reactive filter produced on the ferrite substrate illustrated in FIG. 7 is similar to the distributed element filter shown in FIG. 5C, and comprises a thin (approximately 0.001") conductive micro strip 54, approximately 0.038" wide chosen for a 50 ohm impedance characteristic at high frequencies in a well-known manner. The distributed element filter is designed to provide a high pass characteristic with a cut-off frequency $f_R$ of approximately 1.0 GHz, by providing microstrip portions 58 with a length and width chosen for the correct reactance in a well-known manner. Holes 60 are filled with conductive epoxy or plated through to provide shorts at the end of micro strip portions 58. A two pf chip capacitor 56 is provided between the portions 58.

The combination of the ferrite filter having a critical frequency $f_{CRIT}$ determined by the saturation magnetization of the ferrite material, and the reactive network comprising the distributed elements 56 and 58, having a cut-off frequency of $f_R$ determined by the values of the distributed elements, produces the desired attenuation and reflection coefficient characteristics illustrated in FIG. 6. In this manner, the reactive network provides infinite attenuation at low frequencies where the ferrite substrate filter attenuation drops to a low value.

Figure 8:
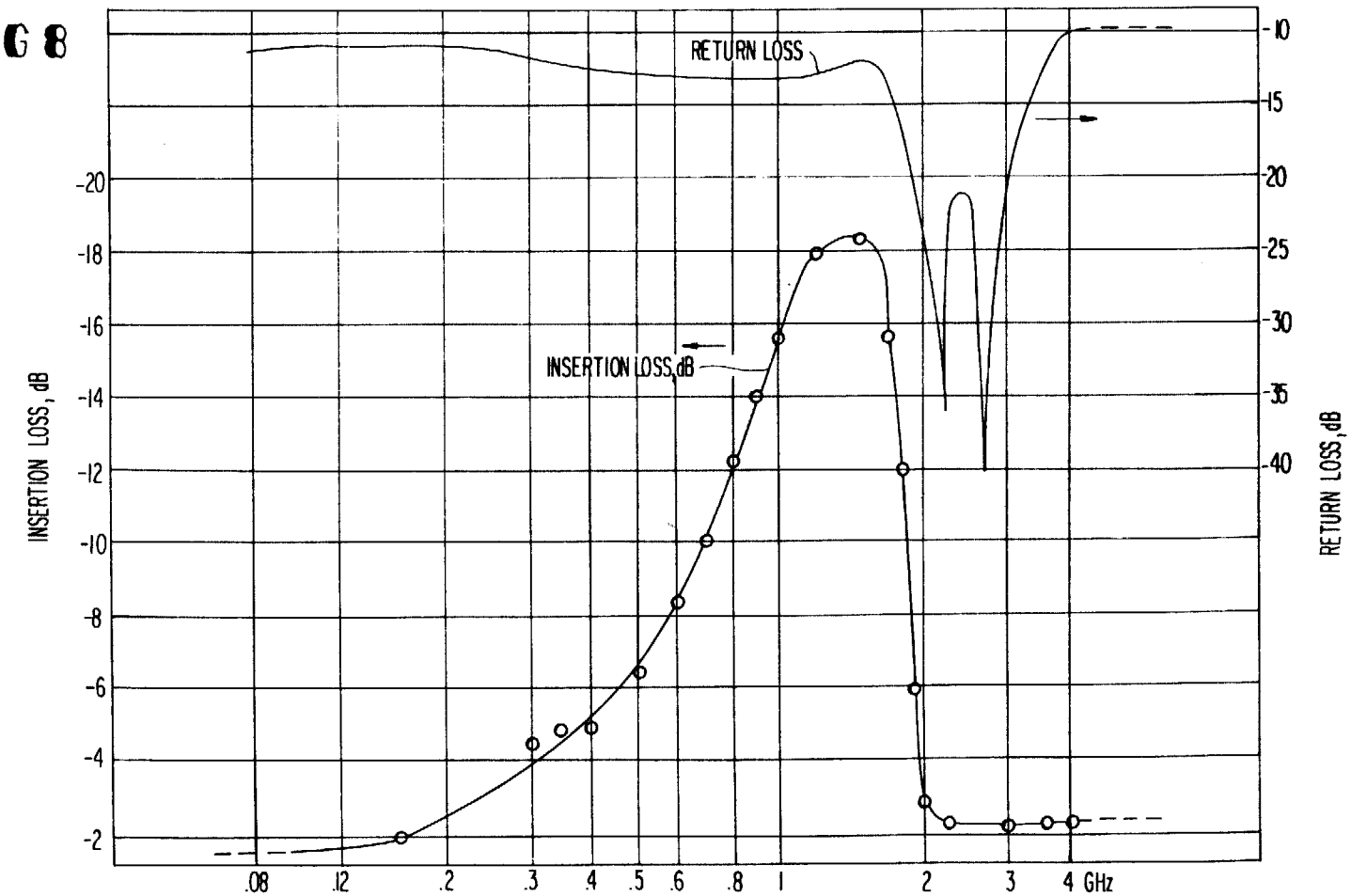
FIGS. 8 and 9 are actual plots of the attentuation and reflection characteristics of the substrate of FIG. 7 without and with the reactive structure, respectively.
Figure 9:
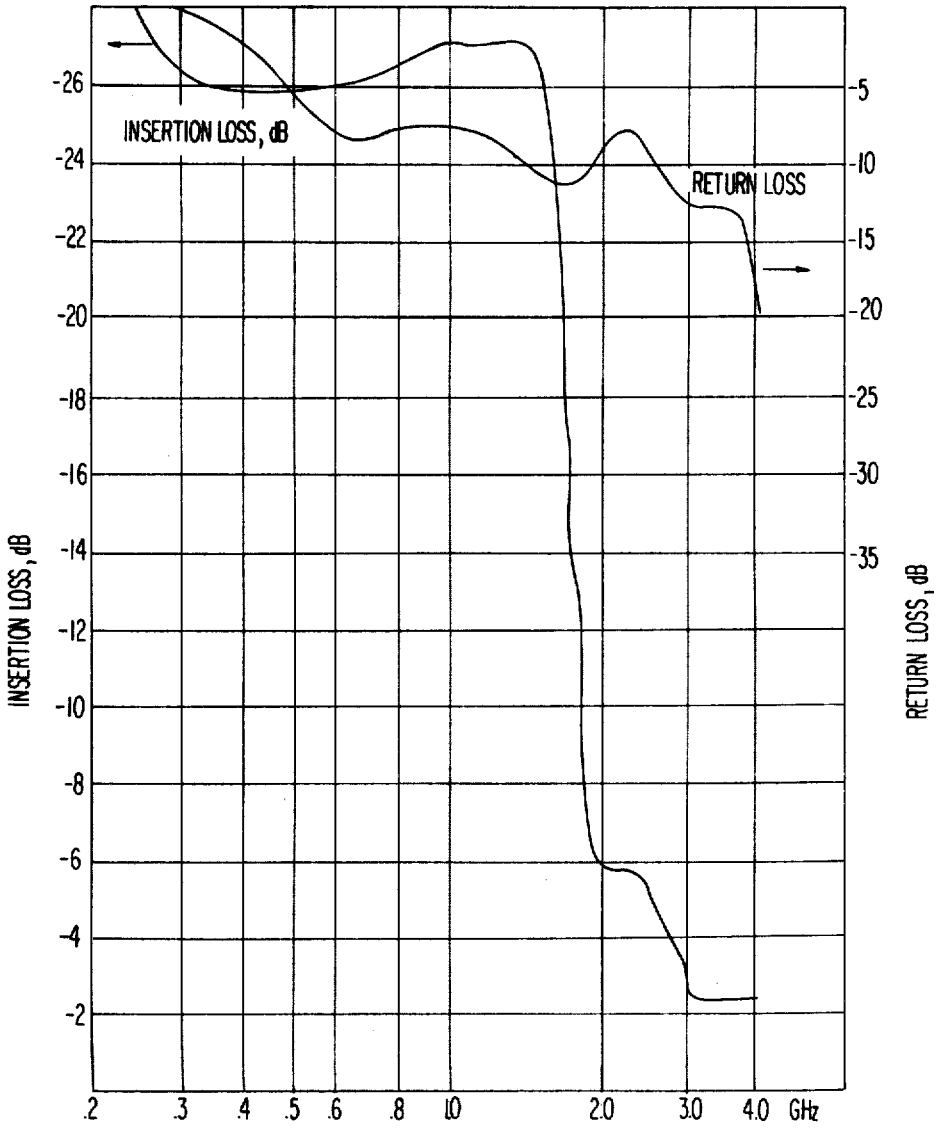

FIGS. 8 and 9 illustrate the measured performance for 2" microstrips having a G-610 ferrite substrate. In FIG. 9 the reactive structure of FIG. 7 was included, whereas in the case of FIG. 8 it was not included. An inspection of FIG. 8 shows test results similar to those indicated in FIG. 3 as well as a relatively low return loss (−20 log (reflected/incident)) due to reflection. An inspection of FIG. 9 illustrates that the characteristics of the ferrite substrate and the reactive structure have been combined to produce favorable results. As expected, the insertion loss or attenuation curve of the combined filter exhibits a very abrupt cut-off phenomenon as well as improved low frequency attenuation. Furthermore, the combination filter does not seriously disrupt the wide band impedance match performance of the substrate filter, as indicated by the return loss curve. In this particular example, a usable band width of 1 decade has been obtained with a reasonably good impedance match, both in the pass band and the stop band.

This aspect of the present invention thus provides a high pass filter having a very abrupt frequency cut-off as well as a good impedance match both above and below the cut-off frequency. The combined characteristics can be changed to suit the user's needs by changing either the type of ferrite substate (select $f_{CRIT}$), or the type and cut-off frequency ($f_R$) of the reactive structure, or both.

The foregoing analysis of the combination non-magnetized ferrite/reactive filter can obviously be generalized to any particular circuit structure having an identifiable frequency characteristic, such as an amplifier, or a frequency multiplier. For example, a tunnel diode amplifier having negative resistance below a desired cut-off frequency, can be deposited on the ferrite substrate having a magnetization saturation which will provide the desired attenuation below the chosen critical frequency in combination with the amplification above the critical frequency provided by the tunnel diode. It is apparent that any particular microwave structure which provided on such a ferrite substrate will have its own frequency characteristic augmented by the ferrite substrate filter characteristic.

Various changes, additions and omissions of elements may be made within the scope and spirit of the invention and it is to be understood that the invention is not limited to specific details, examples and preferred embodiments shown and described herein.

What is claimed is:

1. A microwave filter comprising:

a pair of conductors;

a non-magnetized ferrite material located between said pair of conductors, said ferrite material having a saturation magnetization $4\pi M_s$ chosen to substantially absorb frequencies below a critical frequency $f_{CRIT}$ such that $$f_{CRIT} \approx 2.8 * 4\pi M_s$$

to produce a first filter characteristic, said ferrite material substantially absorbing frequencies below said critical frequency, wherein said first filter characteristic provides (i) high attenuation below said critical frequency, (ii) low attenuation above said critical frequency, and (iii) low reflected-to-incident power ratio above and below said critical frequency.

2. The microwave filter of claim 1 wherein at least one of said pair of conductors has circuit elements located thereon, said circuit elements producing a second filter characteristic, wherein said first and second filter characteristics augment each other to produce desired frequency characteristics.

3. The microwave filter of claim 2 wherein said circuit elements are reactive elements producing a high pass filter characteristic having a reactive cut-off frequency and substantially infinite attenuation at frequencies much lower than said reactive cut-off frequency, said first filter characteristic producing low attenuation at frequencies much lower than said critical frequency, and wherein said desired frequency characteristics have very high attenuation at frequencies much lower than said desired critical frequency.

4. The microwave filter of claim 3 wherein said second filter characteristic produces a large reflected-to-incident power ratio at frequencies below said reactive cut-off frequency.

5. The microwave filter of claim 4 wherein said non-magnetized ferrite material is a substrate for said circuit elements, said circuit elements being deposited on said substrate.

6. The microwave filter of claim 1 wherein said pair of conductors form a microstrip.

7. The microwave filter of claim 1 wherein said pair of conductors form a stripline.

8. The microwave filter of claim 2 wherein said second filter characteristics produces a large reflected to incident power ratio at frequencies below the cutoff frequency of said second filter characteristic.

* * * * *